US011167564B2

(12) United States Patent
Sakurai et al.

(10) Patent No.: US 11,167,564 B2
(45) Date of Patent: Nov. 9, 2021

(54) FOIL TRANSFER APPARATUS

(71) Applicant: DGSHAPE Corporation, Hamamatsu (JP)

(72) Inventors: Takayuki Sakurai, Hamamatsu (JP); Tsutomu Kuno, Hamamatsu (JP); Masaki Nakabayashi, Hamamatsu (JP); Akari Sakuragi, Hamamatsu (JP)

(73) Assignee: DGSHAPE CORPORATION, Shizuoaka (JP)

( * ) Notice: Subject to any disclaimer, the term of this patent is extended or adjusted under 35 U.S.C. 154(b) by 0 days.

(21) Appl. No.: 17/023,441

(22) Filed: Sep. 17, 2020

(65) Prior Publication Data

US 2021/0078339 A1 Mar. 18, 2021

(30) Foreign Application Priority Data

Sep. 18, 2019 (JP) ..... JP2019-169009

(51) Int. Cl.

| | |
|---|---|
| ***B41J 2/475*** | (2006.01) |
| ***B41J 25/304*** | (2006.01) |
| ***B41M 5/382*** | (2006.01) |
| *B41F 16/00* | (2006.01) |

(52) U.S. Cl.

CPC ..... *B41J 2/475* (2013.01); *B41J 25/304* (2013.01); *B41M 5/38242* (2013.01); *B41F 16/006* (2013.01); *B41F 16/008* (2013.01); *B41F 16/0046* (2013.01); *B41M 5/382* (2013.01)

(58) Field of Classification Search

CPC .... B41J 2/475; B41J 25/304; B41M 5/38242; B41M 5/382; B41F 16/006; B41F 16/0046; B41F 16/008

See application file for complete search history.

(56) References Cited

U.S. PATENT DOCUMENTS

| | | | | |
|---|---|---|---|---|
| 9,010,926 | B2 * | 4/2015 | Moriya | B41J 11/00 347/104 |
| 10,569,567 | B2 * | 2/2020 | Kuno | B41J 2/48 |
| 2018/0111409 | A1 | 4/2018 | Takahashi | |
| 2019/0092010 | A1 | 3/2019 | Matsumoto et al. | |
| 2019/0111720 | A1 * | 4/2019 | Takahashi | B41M 5/46 |

FOREIGN PATENT DOCUMENTS

| | | | |
|---|---|---|---|
| JP | 2013-202839 | A | 10/2013 |
| JP | 2018-069501 | A | 5/2018 |
| JP | 6343255 | B2 | 6/2018 |
| JP | 2019-055565 | A | 4/2019 |

* cited by examiner

*Primary Examiner* — Henok D Legesse

(74) *Attorney, Agent, or Firm* — Keating & Bennett, LLP

(57) ABSTRACT

A Y-axis direction moving mechanism that moves a Y-axis carriage includes a right first driving pulley configured to retract and pay out a right first wire and located in a housing, a right first driven pulley on the Y-axis carriage and around which the right first wire is wound, and a Y-axis motor configured to drive and rotate the right first driving pulley. An X-axis direction moving mechanism that moves an X-axis carriage includes a second driving pulley configured to retract and pay out a second wire and on a Y-axis carriage, a second driven pulley on an X-axis carriage and around which the second wire is wound, and an X-axis motor configured to drive and rotate the second driving pulley.

9 Claims, 10 Drawing Sheets

FOIL TRANSFER APPARATUS

CROSS REFERENCE TO RELATED APPLICATIONS

This application claims the benefit of priority to Japanese Patent Application No. 2019-169009 filed on Sep. 18, 2019. The entire contents of this application are hereby incorporated herein by reference.

BACKGROUND OF THE INVENTION

1. Field of the Invention

The present invention relates to a foil transfer apparatus.

2. Description of the Related Art

A decorative process by a heat transfer technique using thermal transfer foil (also called a heat transfer sheet) has been performed to date for purposes such as enhancement of aesthetic design. The thermal transfer foil is generally constituted by stacking a base material, a decorative layer, and an adhesive layer in this order. In performing transfer, thermal transfer foil is overlaid on a transfer object such that an adhesive layer of the foil contacts the transfer object, and the thermal transfer foil is heated by applying light with the thermal transfer foil being pressed from above with a transfer tool including a light source for applying light (e.g., laser light) and a pressing body for pressing the thermal transfer foil. Accordingly, the adhesive layer in a pressed portion of the thermal transfer foil is melted and attached to the surface of the transfer object, and then is cured by heat dissipation. Consequently, the base material of the thermal transfer foil is separated from the transfer object so that a decorative layer having a shape corresponding to the portion stamped with the foil can be attached to the transfer object together with the adhesive layer. In this manner, the surface of the transfer object is provided with a decoration having an intended shape (e.g., a figure or a character).

In the foil transfer apparatus described in Japanese Patent Application Publication No. 2018-69501, a transfer tool is configured to be movable along an X axis, a Y axis, and a Z axis. That is, the foil transfer tool is configured to be movable along the X axis, the Y axis, and the Z axis (i.e., in three dimensions) relative to a transfer object placed on a stand by rotating feed screw rods extending along these axes. The foil transfer apparatus described in Japanese Patent Application Publication No. 2018-69501 is an apparatus for transferring thermal transfer foil onto a relatively small transfer object. Thus, the movable range of the transfer tool is relatively small, and the transfer tool can be appropriately moved by the feed screw rods.

However, if the size of the foil transfer apparatus is to be increased in order to transfer thermal transfer foil onto a relatively large transfer object, resistance in moving the transfer tool might increase depending on the accuracy in molding the feed screw rods. In addition, the increased size of the transfer object increases the time necessary for transferring thermal transfer foil, and thus, it is required to move the transfer tool at higher speed. If these drawbacks are to be solved by using the feed screw rods, it is necessary to increase the size of a driving source (e.g., a motor) for rotating the feed screw rods or to mold the feed screw rods with higher accuracy. That is, costs for the foil transfer apparatus might increase.

SUMMARY OF THE INVENTION

Preferred embodiments of the present invention provide foil transfer apparatuses each capable of transferring thermal transfer foil onto a relatively large transfer object and preventing increases in costs.

A foil transfer apparatus according to a preferred embodiment of the present invention includes a housing, a support base located in the housing and including a mount surface on which a transfer object is allowed to be mounted, a transfer tool to press the transfer object and thermal transfer foil placed on the transfer object and to apply light to the thermal transfer foil, and a moving mechanism to move the transfer tool relative to the support base. The moving mechanism includes a first guide shaft located above the support base, disposed in the housing, and extending in a first direction, the first direction being parallel or substantially parallel to the mount surface, a first carriage located above the support base, slidably disposed on the first guide shaft, and movable in the first direction, a first carriage moving mechanism to move the first carriage in the first direction, a second guide shaft located above the support base, located on the first carriage, and extending in a second direction, the second direction being perpendicular or substantially perpendicular the first direction, a second carriage located above the support base, slidably provided on the second guide shaft, holding the transfer tool, and movable in the second direction, and a second carriage moving mechanism to move the second carriage in the second direction. The first carriage moving mechanism includes a first wire, a first driving pulley located in the housing to retract and pay out the first wire, a first driven pulley on the first carriage, the first wire being wound around the first driven pulley, and a first driving source connected to the first driving pulley to drive and rotate the first driving pulley. The second carriage moving mechanism includes a second wire, a second driving pulley on the first carriage to retract and pay out the second wire, a second driven pulley on the second carriage, the second wire being wound around the second driven pulley, and a second driving source connected to the second driving pulley to drive and rotate the second driving pulley.

In a foil transfer apparatus of a preferred embodiment of the present invention, the transfer tool can be moved in the first direction (e.g., along the Y axis) by the first carriage moving mechanism and in the second direction (e.g., along the X axis) by the second carriage moving mechanism. In this example, the first carriage moving mechanism moves the first carriage by using the first wire, whereas the second carriage moving mechanism moves the second carriage by using the second wire. In this manner, the transfer tool can be moved at high speed with a thrust smaller than that in the case of using feed screw rods. That is, an increase in size of a driving source (e.g., motor) is prevented. In addition, the movable range of the transfer tool is able to be enlarged by changing the lengths of the first wire and the second wire. Accordingly, thermal transfer foil can be transferred onto a relatively large transfer object.

According to preferred embodiments of the present invention, it is possible to provide foil transfer apparatuses each capable of transferring thermal transfer foil onto a relatively large transfer object and prevent cost increases.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
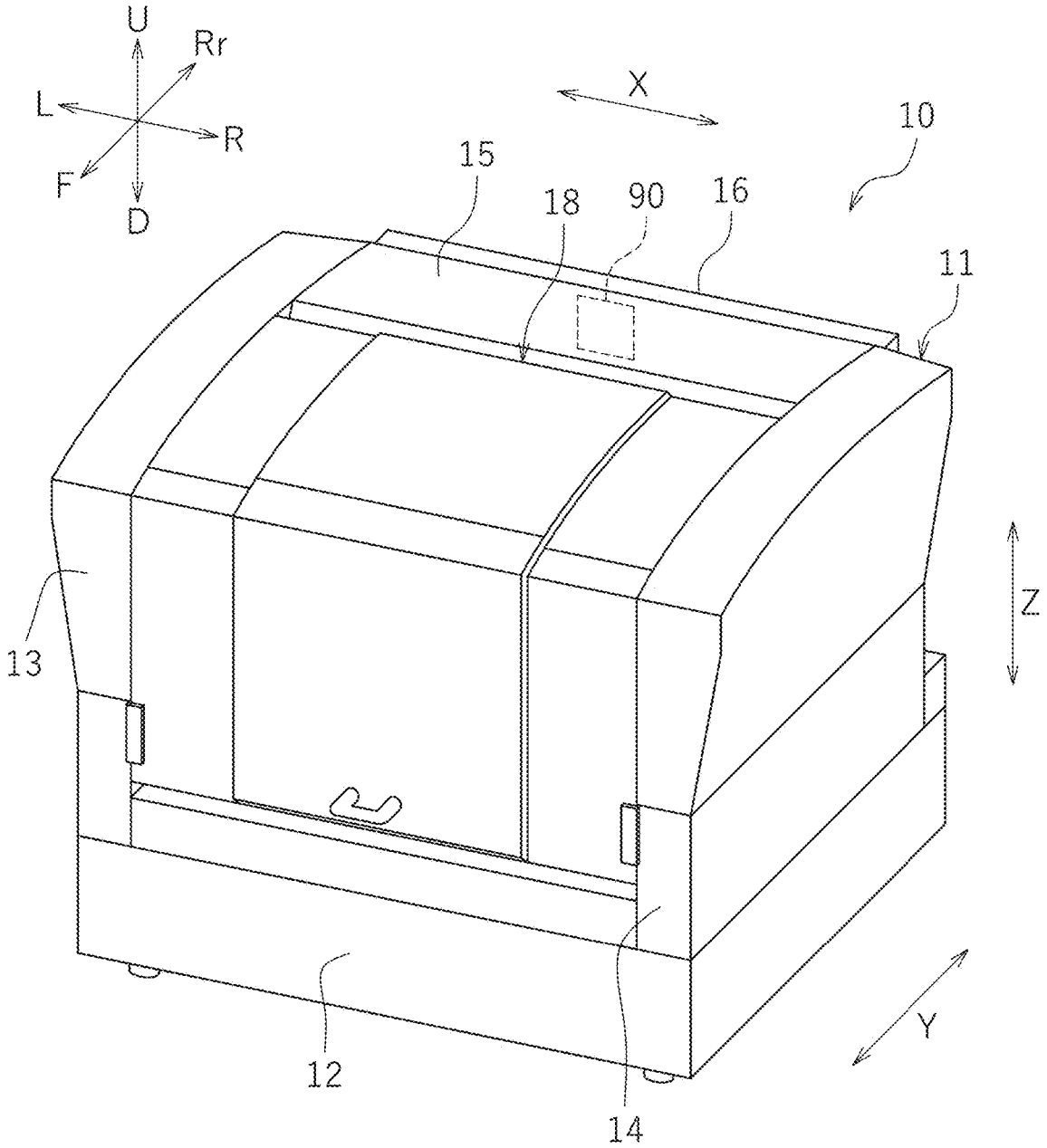
FIG. 1 is a perspective view illustrating a foil transfer apparatus according to a preferred embodiment of the present invention.

Preferred embodiments of the present invention will be described hereinafter with reference to the drawings. The preferred embodiments described here are, of course, not intended to particularly limit the present invention. Elements and features having the same functions are denoted by the same reference numerals, and description for the same elements and features will not be repeated or will be simplified as appropriate.

Figure 2:
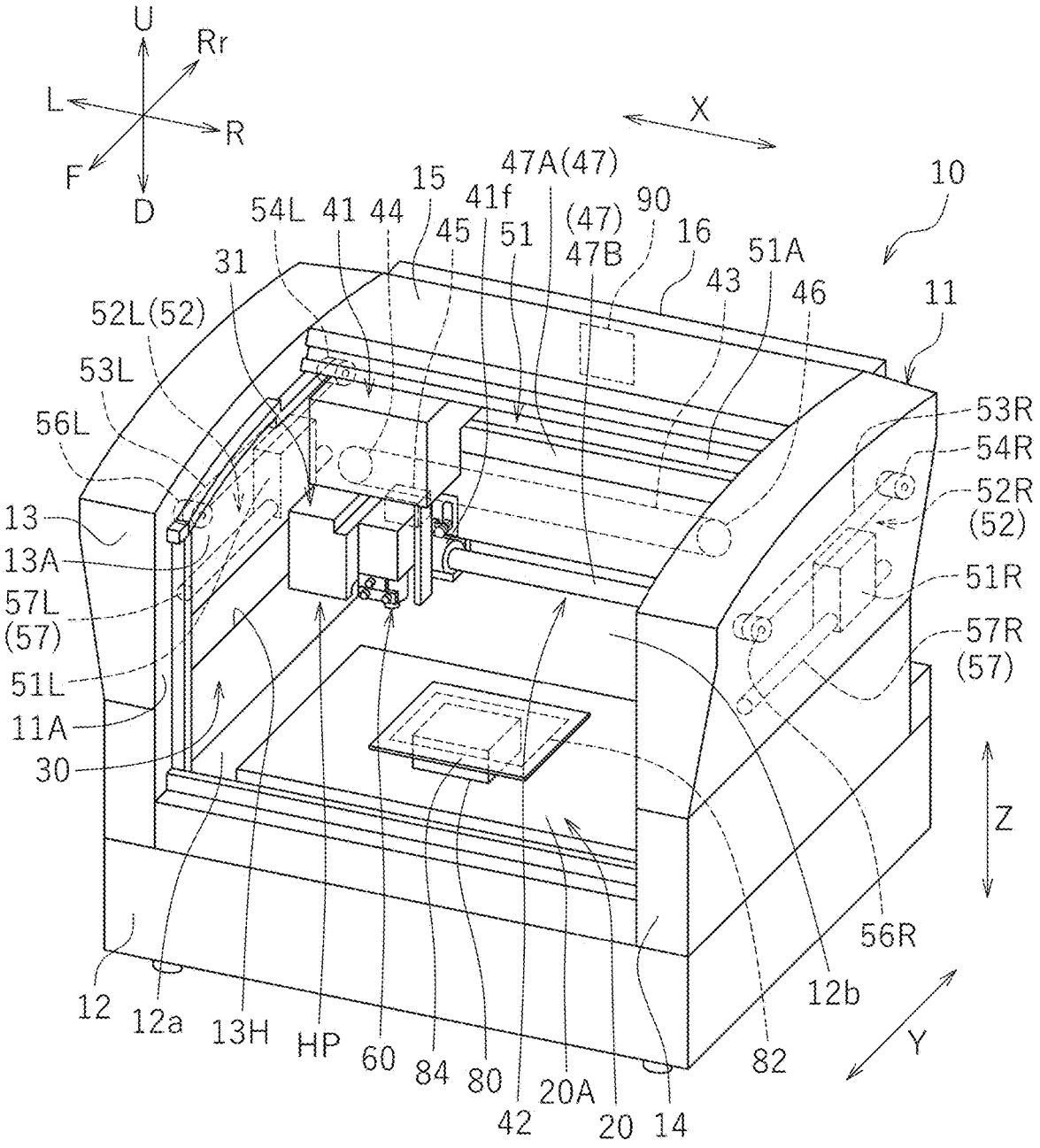
FIG. 2 is a perspective view illustrating a state where a cover is detached from a foil transfer apparatus according to a preferred embodiment of the present invention.

FIG. 1 is a perspective view illustrating a foil transfer apparatus 10 according to a preferred embodiment of the present invention. FIG. 2 is a perspective view illustrating the foil transfer apparatus 10 from which a cover 18 is detached. In the following description, left, right, up, and down refer to left, right, up, and down, respectively, when a user in front of the foil transfer apparatus 10 sees the foil transfer apparatus 10. When seen from the user, a direction toward the foil transfer apparatus 10 will be referred to as rearward, and a direction away from the foil transfer apparatus 10 will be referred to as forward. Characters F, Rr, L, R, U, and D in the drawings represent front, rear, left, right, up, and down, respectively. Supposing axes perpendicular or substantially perpendicular one another are an X axis, a Y axis, and a Z axis, the foil transfer apparatus 10 according to this preferred embodiment is placed on a plane constituted by the X axis and the Y axis. Here, the X axis extends leftward and rightward. A direction along the X axis (i.e., left-right direction) is an example of a second direction. The Y axis extends forward and rearward. A direction along the Y axis (i.e., front-rear direction) is an example of a first direction. A plane constituted by the X axis and the Y axis is a horizontal plane in this preferred embodiment. The Z axis extends upward and downward (in top-bottom directions). A direction along the Z axis refers to a top-bottom direction. It should be noted that these directions are defined simply for convenience of description, and do not limit the state of installation of the foil transfer apparatus 10.

As illustrated in FIG. 2, the foil transfer apparatus 10 applies or transfers a decorative layer in a sheet-shaped thermal transfer foil 82 onto a surface of a transfer object 80 by pressing and heating the thermal transfer foil 82 and a light absorption film 84 with a transfer tool 60 described later with the thermal transfer foil 82 and the light absorption film 84 being overlaid on the transfer object 80. The thermal transfer foil 82 is indirectly pressed against the transfer tool 60 with the light absorption film 84 interposed therebetween. The light absorption film 84 is unnecessary in some cases depending on the materials, shapes, and configurations of the transfer object 80 and the thermal transfer foil 82. The light absorption film 84 is unnecessary for some types of a laser oscillator mounted on the foil transfer apparatus 10. For example, the light absorption film 84 does not need to be used in a case where the laser oscillator is capable of outputting laser light having a heat quantity necessary to transfer the thermal transfer foil 82 onto the transfer object 80.

The material constituting the transfer object 80 and the shape of the transfer object 80 are not specifically limited. Examples of the material for the transfer object 80 include: metal such as gold, silver, copper, platinum, brass, aluminum, iron, titanium, and stainless; resin materials such as acrylic, polyvinyl chloride (PVC), polyethylene terephthalate (PET), and polycarbonate (PC); papers such as plain paper, drawing paper, and Japanese paper; and rubbers. Examples of the material for the transfer object 80 also include genuine leather (i.e., natural leather) and artificial leather (e.g., synthetic leather or faux leather) at least partially including the resin material described above and/or other materials.

The thermal transfer foil 82 may be, but is not limited to, transfer foil commercially available for heat transfer, for example. The thermal transfer foil 82 is typically a stack of a base material, a decorative layer, and an adhesive layer in this order. The thermal transfer foil 82 includes, for example, metallic foil such as gold foil and sliver foil, half metallic foil, pigment foil, multi-color printing foil, hologram foil, and electrostatic destruction measures foil. The thermal transfer foil 82 has a band shape or a sheet shape. The thermal transfer foil 82 is placed on the transfer object 80. The thermal transfer foil 82 is placed on the transfer object 80 such that the adhesive layer of the thermal transfer foil 82 contacts the transfer object 80. The thermal transfer foil 82 may further include a light absorption layer between the base material and the decorative layer. In a case where the thermal transfer foil 82 includes a light absorption layer, the base material is made of a transparent material. The light absorption layer has a configuration similar to that of the light absorption film 84 described later. In the case where the thermal transfer foil 82 includes the light absorption layer, the foil transfer apparatus 10 does not need to include the light absorption film 84 in some cases. Even in the case where the thermal transfer foil 82 includes the light absorption layer, the foil transfer apparatus 10 preferably includes the light absorption film 84.

Some configurations of the thermal transfer foil 82 to be used can have no or poor light absorption property to light applied from a laser oscillator 62 (see FIG. 3) of the transfer tool 60 described later. In such cases, the light absorption film 84 is placed on top of the thermal transfer foil 82. The light absorption film 84 refers to a sheet configured to efficiently absorb laser light in a predetermined wavelength range applied from the laser oscillator 62 of the transfer tool 60 and to convert optical energy to thermal energy. The light absorption film 84 has a heat resistance at about 100° C. to about 200° C. The light absorption film 84 is made of a resin such as polyimide. The light absorption film 84 is monochrome. From the viewpoint of efficiently converting optical energy to thermal energy, the hue of the light absorption film 84 is preferably complementary to the color of laser light applied from the light source 62. For example, in a case where laser light applied from the laser oscillator 62 is blue, the light absorption film 84 is preferably yellow. The light absorption film 84 may be provided with a support film to increase strength as necessary. The support film has a light absorption property significantly lower than that of the light absorption film 84. The support film has a light transmittance higher than that of the light absorption film 84. The support film is made of a material transparent to laser light emitted from the laser oscillator 62. The support film is, for example, transparent. The support film is a plastic film such as polyester.

As illustrated in FIG. 1, the foil transfer apparatus 10 has a box shape. As illustrated in FIG. 2, the foil transfer apparatus 10 includes a housing 11 with an opening 11A that is open at the front and at the top, a cover 18 (see FIG. 1) configured to cover and uncover the opening 11A, a pressing body moving mechanism 30 disposed in the housing 11, a transfer tool 60, a support base 20 on which a transfer object 80 can be placed, and a controller 90. The cover 18 is supported by the housing 11 to be rotatable on the rear end of the cover 18. When the cover 18 is rotated upward, an internal space of the housing 11 communicates with an external space of the housing 11. The housing 11 includes a bottom wall portion 12, a left side wall portion 13, a right side wall portion 14, an upper wall 15, and a rear wall 16.

As illustrated in FIG. 1, the bottom wall portion 12 is provided with the support base 20. The length of the bottom wall portion 12 along the X axis is smaller than the length of the bottom wall portion 12 along the Y axis. A region ahead of the bottom wall portion 12 is a first region 12*a* where the support base 20 is disposed. A region behind the bottom wall portion 12 is a second region 12*b* on which the transfer object 80 placed on the support base 20 can be placed across the support base 20.

As illustrated in FIG. 1, the left side wall portion 13 extends upward at the left end of the bottom wall portion 12. The left side wall portion 13 is perpendicular or substantially perpendicular to the bottom wall portion 12. The right side wall portion 14 extends upward at the right end of the bottom wall portion 12. The right side wall portion 14 is perpendicular or substantially perpendicular to the bottom wall portion 12. The rear wall portion 16 extends upward at the rear end of the bottom wall portion 12. The rear wall portion 16 is connected to the rear end of the left side wall portion 13 and the rear end of the right side wall portion 14. The rear wall portion 16 houses a controller 90 described later. The upper wall portion 15 is connected to the upper end of a rear portion of the left side wall portion 13, the upper end of a rear portion of the right side wall portion 14, and the upper end of the rear wall portion 16. A region surrounded by the bottom wall portion 12, the left side wall portion 13, the right side wall portion 14, the upper wall portion 15, and the rear wall portion 16 is an internal space of the housing 11. The left side wall portion 13 and the right side wall portion 14 are individually provided with Y-axis shafts 57 described later.

As illustrated in FIG. 2, the support base 20 is located in the housing 11. The support base 20 includes a mount surface 20A on which the transfer object 80 can be mounted. In this preferred embodiment, the mount surface 20A is parallel or substantially parallel to a horizontal plane. The mount surface 20A is parallel or substantially parallel to the X axis and the Y axis. The mount surface 20A is located above the bottom wall portion 12. The support base 20 has a rectangular shape whose length along the X axis is larger than the length along the Y axis. The support base 20 may be configured such that the length along the X axis is larger than the length along the Y axis or the length along the X axis is equal to the length along the Y axis.

As illustrated in FIG. 2, the internal space of the housing 11 is a space where the thermal transfer foil 82 is transferred onto the transfer object 80. The pressing body moving mechanism 30 is provided in the internal space. That is, the pressing body moving mechanism 30 is housed in the housing 11. The pressing body moving mechanism 30 is an example of a moving mechanism. The pressing body moving mechanism 30 includes a Z-axis carriage 31 that holds the transfer tool 60, an X-axis carriage 41 that holds the Z-axis carriage 31, a Y-axis carriage 51 that holds the X-axis carriage 41, a Z-axis shaft 37 (see FIG. 3) located above the support base 20 and disposed on the X-axis carriage 41, an X-axis shaft 47 located above the support base 20 and disposed on the Y-axis carriage 51, a Y-axis shafts 57 located above the support base 20 and disposed in the housing 11 (more specifically on the left side wall portion 13 and the right side wall portion 14), a Z-axis direction moving mechanism 32 (see FIG. 3) that moves the Z-axis carriage 31 along the Z axis, an X-axis direction moving mechanism 42 that moves the Z-axis carriage 31 and the X-axis carriage 41 along the X axis, and a Y-axis direction moving mechanism 52 that moves the Z-axis carriage 31, the X-axis carriage 41, and the Y-axis carriage 51 along the Y axis. The Z-axis shaft 37 extends along the Z axis. The X-axis shaft 47 extends along the X axis. The Y-axis shafts 57 extend along the Y axis. The pressing body moving mechanism 30 moves the transfer tool 60 in three dimensions. The transfer tool 60 is movable relative to the support base 20 (i.e., the transfer object 80) by the Z-axis direction moving mechanism 32, the X-axis direction moving mechanism 42, and the Y-axis direction moving mechanism 52. That is, the pressing body moving mechanism 30 moves a pressing body 66 (see FIG. 3) of the transfer tool 60 relative to the support base 20. The Z-axis direction moving mechanism 32, the X-axis direction moving mechanism 42, and the Y-axis direction moving mechanism 52 are located above the bottom wall portion 12. The Z-axis carriage 31 is an example of a third carriage. The X-axis carriage 41 is an example of a second carriage. The Y-axis carriage 51 is an example of a first carriage. The Z-axis shaft 37 is an example of a third guide shaft. The X-axis shaft 47 is an example of a second guide shaft. The Y-axis shafts 57 are an example of a first guide shaft. The Z-axis direction moving mechanism 32 is an example of a third carriage moving mechanism. The X-axis direction moving mechanism 42 is an example of a second carriage moving mechanism. The Y-axis direction moving mechanism 52 is an example of a first carriage moving mechanism.

Figure 3:
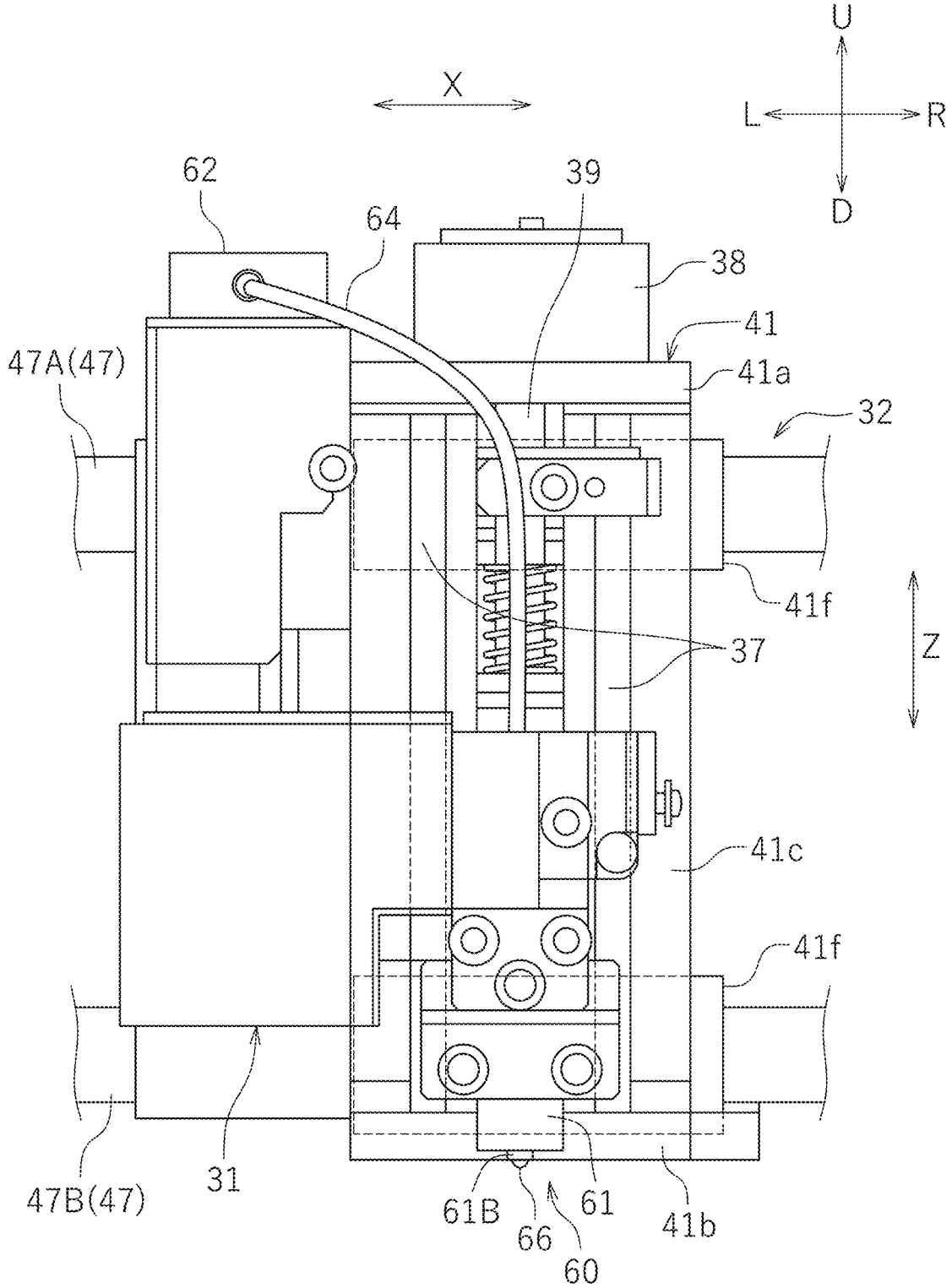
FIG. 3 is a front view schematically illustrating a configuration of a transfer tool according to a preferred embodiment of the present invention and the vicinity of the transfer tool.

As illustrated in FIG. 2, the Z-axis carriage 31 is located above the support base 20. The Z-axis carriage 31 preferably has a box shape. As illustrated in FIG. 3, the Z-axis carriage 31 is slidably disposed on a pair of Z-axis shafts 37. The Z-axis carriage 31 holds at least a portion of the transfer tool 60 (e.g., a case body 61 described later). The Z-axis carriage 31 is movable along the Z axis.

Figure 4:
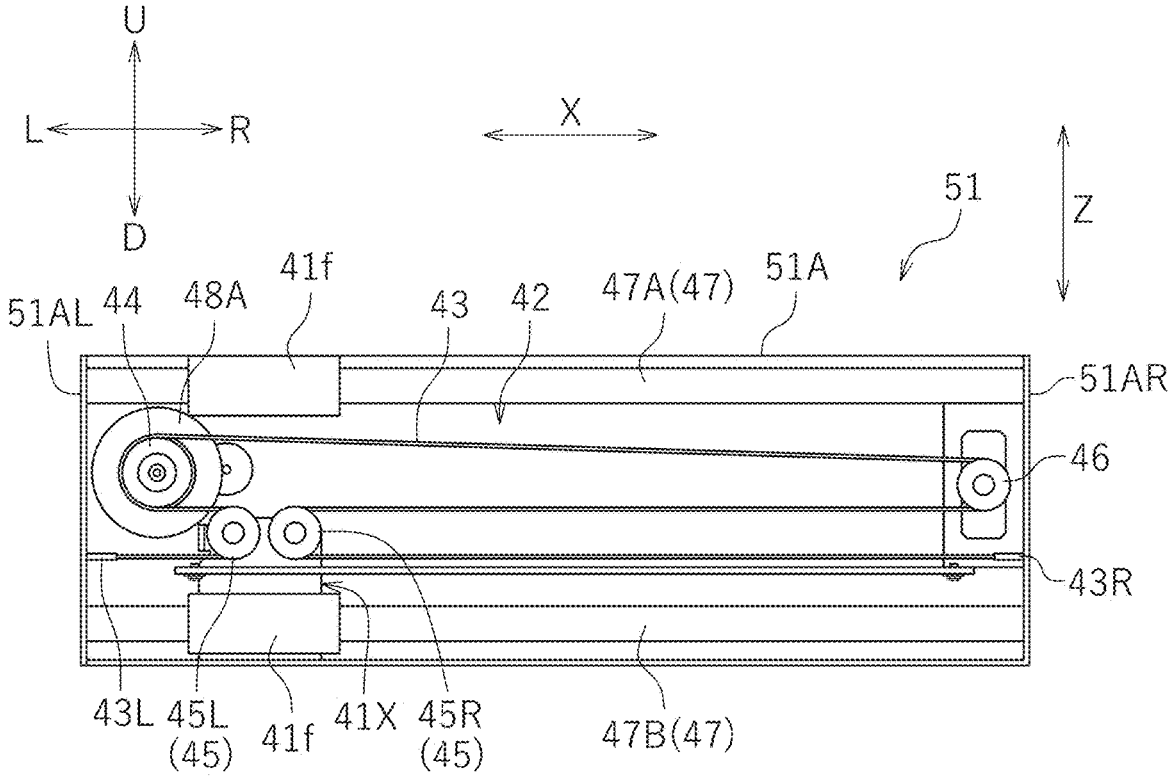
FIG. 4 is a front view schematically illustrating an X-axis direction moving mechanism according to a preferred embodiment of the present invention.

As illustrated in FIG. 2, the X-axis carriage 41 is located above the support base 20. As illustrated in FIG. 3, the X-axis carriage 41 includes a first portion 41*a* extending along the Y axis and the X axis, a second portion 41*b* located below the first portion 41*a* and extending along the Y axis and the X axis, and a third portion 41*c* connecting the rear end of the first portion 41*a* and the rear end of the second portion 41*b* and extending along the Z axis. The Z-axis shaft 37 is supported by the first portion 41*a* and the second portion 41*b* of the X-axis carriage 41. The X-axis carriage 41 holds the Z-axis carriage 31. The X-axis carriage 41 indirectly holds the transfer tool 60 with the Z-axis carriage 31 interposed therebetween. A guide support portion 41*f* in which the X-axis shaft 47 is inserted is provided in a rear portion of the third portion 41*c*. The X-axis carriage 41 is slidably disposed on a pair of X-axis shafts 47. The X-axis carriage 41 is movable along the X axis. As illustrated in FIG. 4, the X-axis carriage 41 includes a sliding member 41X in a rear portion of the guide support portion 41*f*. The sliding member 41X supports a left driven pulley 45L and a right driven pulley 45R described later. The sliding member 41X is housed in the Y-axis carriage 51.

As illustrated in FIGS. 2 and 4, the X-axis shafts 47 include an upper X-axis shaft 47A and a lower X-axis shaft 47B disposed in a body 51A of the Y-axis carriage 51 described later. The upper X-axis shaft 47A is an example of an upper second guide shaft. The lower X-axis shaft 47B is an example of a lower second guide shaft. The upper X-axis shaft 47A and the lower X-axis shaft 47B extend along the X axis. The lower X-axis shaft 47B is located below the upper X-axis shaft 47A.

Figure 6:
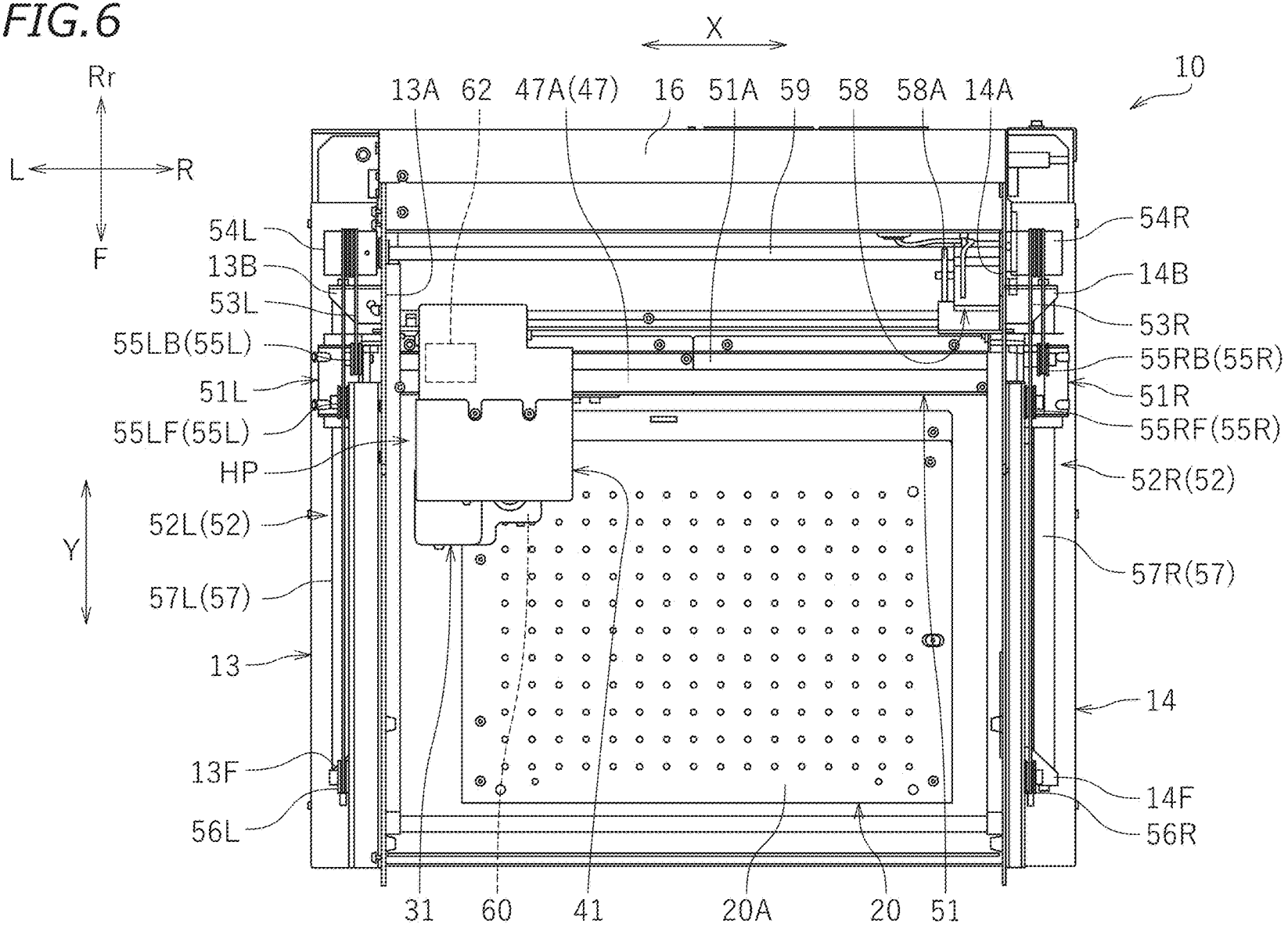
FIG. 6 is a plan view schematically illustrating a Y-axis direction moving mechanism when a Y-axis carriage according to a preferred embodiment of the present invention is located at a rearmost position.

As illustrated in FIG. 2, the Y-axis carriage 51 is located above the support base 20. The Y-axis carriage 51 is located below the upper wall 15 and above the bottom wall portion 12. As illustrated in FIG. 6, the Y-axis carriage 51 is located behind the support base 20 while the transfer tool 60 is located at a standby position HP. In this preferred example, the standby position HP is a position at which the transfer tool 60 is kept on standby at a stamping standby time, that is, while the thermal transfer foil 82 is not transferred onto the transfer object 80. In this preferred embodiment, the standby position HP is located at the left ends of the first X-axis shafts 47 and the rear ends of the Y-axis shafts 57. The Y-axis carriage 51 preferably has a box shape. The Y-axis carriage 51 includes a body 51A defined by an inner wall 13A of the left side wall portion 13 to an inner wall 14A of the right side wall portion 14, a left sliding member 51L disposed in the left side wall portion 13 and integrally formed with the body 51A, and a right sliding member 51R disposed in the right side wall portion 14 and integrally formed with the body 51A. The Y-axis carriage 51 moves along the Y axis along an opening 13H (see FIG. 9) provided in the inner wall 13A of the left side wall portion 13 and an opening 14H (see FIG. 7) provided in the inner wall 14A of the right side wall portion 14. The opening 13H and the opening 14H preferably have rectangular shapes extending along the Y axis. The X-axis shaft 47 is supported by the body 51A. The Y-axis carriage 51 holds the X-axis carriage 41. The Y-axis carriage 51 is slidably disposed on the pair of Y-axis shafts 57 (i.e., the left Y-axis shaft 57L and the right Y-axis shaft 57R). The Y-axis carriage 51 is movable along the Y axis.

Figure 8:
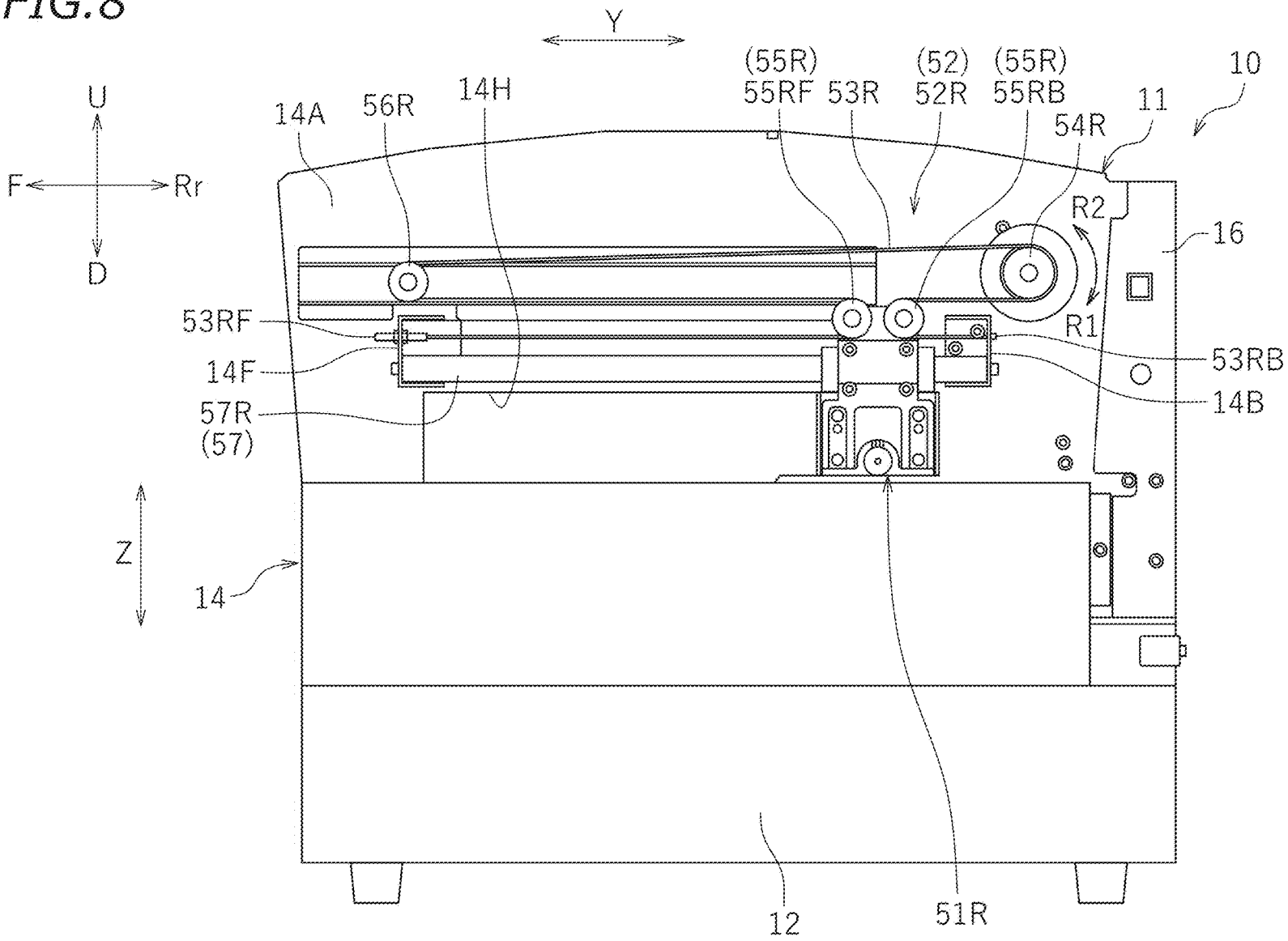
FIG. 8 is a right side view schematically illustrating a portion of a Y-axis direction moving mechanism when a Y-axis carriage according to a preferred embodiment of the present invention is located at a rearmost position.
Figure 9:
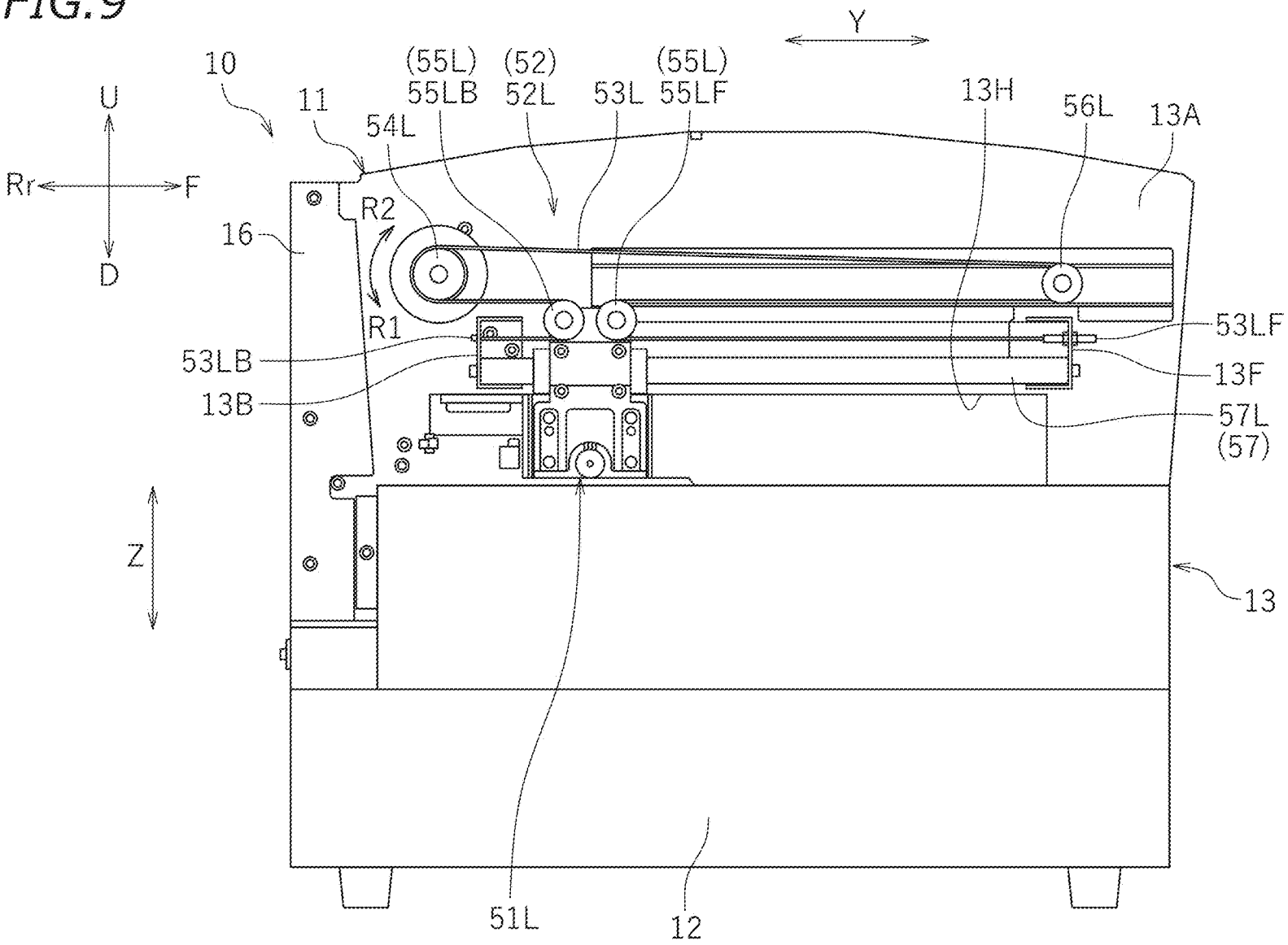
FIG. 9 is a left side view schematically illustrating a portion of a Y-axis direction moving mechanism when a Y-axis carriage according to a preferred embodiment of the present invention is located at a rearmost position.

As illustrated in FIGS. 8 and 9, the Y-axis shafts 57 include the right Y-axis shaft 57R supported by a front support plate 14F and a rear support plate 14B disposed on the inner wall 14A of the right side wall portion 14, and a left Y-axis shaft 57L supported by a front support plate 13F and a rear support plate 13B disposed on the inner wall 13A of the left side wall portion 13. The front support plate 14F and the rear support plate 14B extend rightward from the inner wall 14A. The front support plate 14F is located ahead of the rear support plate 14B. The front support plate 13F and the rear support plate 13B extend leftward from the inner wall 13A. The front support plate 13F is located ahead of the rear support plate 13B.

As illustrated in FIG. 3, the Z-axis direction moving mechanism 32 is disposed on the X-axis carriage 41. The Z-axis direction moving mechanism 32 moves the pressing body 66 of the transfer tool 60 along the Z axis. The Z-axis direction moving mechanism 32 includes a trapezoidal screw 39 and a Z-axis motor 38. The trapezoidal screw 39 is an example of a feed screw. The Z-axis motor 38 is an example of a third driving source. The trapezoidal screw 39 extends along the Z axis. The trapezoidal screw 39 penetrates the first portion 41*a* of the X-axis carriage 41. The upper end of the trapezoidal screw 39 is connected to the Z-axis motor 38. The lower end of the trapezoidal screw 39 is connected to the Z-axis carriage 31. The Z-axis motor 38 drives and rotates the trapezoidal screw 39. The Z-axis motor 38 is located on the first portion 41*a* of the X-axis carriage 41. The Z-axis motor 38 is an electric motor. The Z-axis motor 38 is controlled by the controller 90 (see FIG. 2). When the Z-axis motor 38 is driven, rotation of the trapezoidal screw 39 causes the Z-axis carriage 31 to move along the Z-axis shaft 37 along the Z axis.

Figure 5:
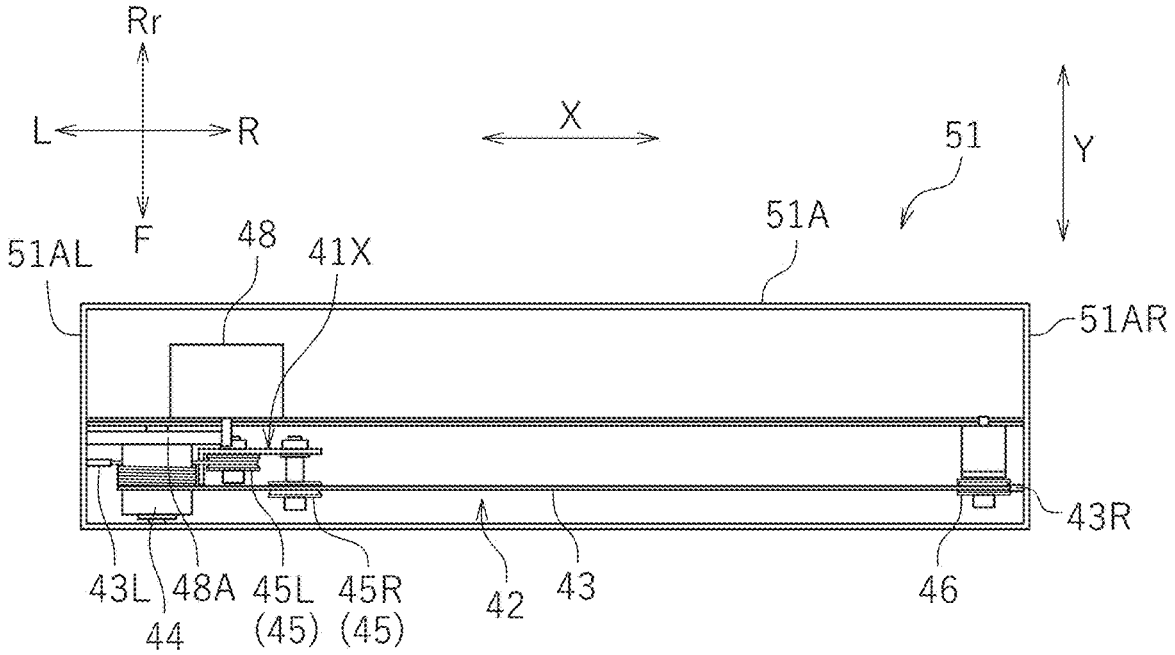
FIG. 5 is a plan view schematically illustrating an X-axis direction moving mechanism according to a preferred embodiment of the present invention.

As illustrated in FIG. 2, the X-axis direction moving mechanism 42 is disposed on the Y-axis carriage 51. The X-axis direction moving mechanism 42 moves the pressing body 66 of the transfer tool 60 along the X axis. As illustrated in FIG. 4, the X-axis direction moving mechanism 42 is located below the upper X-axis shaft 47A and above the lower X-axis shaft 47B. The X-axis direction moving mechanism 42 includes a second wire 43, a second driving pulley 44, a second driven pulley 45, a second auxiliary pulley 46, and an X-axis motor 48 (see FIG. 5). A left end 43L of the second wire 43 is fixed to the left support plate 51AL. A right end 43R of the second wire 43 is fixed to the right support plate 51AR. The left support plate 51AL and the right support plate 51AR are respectively disposed at the left end and the right end of the body 51A. The second wire 43 is sequentially wound around the left driven pulley 45L described later, the second driving pulley 44, the second auxiliary pulley 46, and the right driven pulley 45R described later, from the left end 43L to the right end 43R. The second driving pulley 44 is configured to retract and pay out the second wire 43. That is, the second wire 43 can be wound around the second driving pulley 44 multiple times. The second driving pulley 44 is disposed on the Y-axis carriage 51. The second driving pulley 44 is disposed at the left end of the body 51A. The second driven pulley 45 is disposed on the sliding member 41X of the X-axis carriage 41 (see FIG. 2). The second wire 43 is wound around the second driven pulley 45. The second driven pulley 45 is located between the second auxiliary pulley 46 and the second driving pulley 44 when seen along the Y axis (i.e., in front view). The second driven pulley 45 includes the left driven pulley 45L and the right driven pulley 45R located at the right of the left driven pulley 45L. As illustrated in FIG. 5, the right driven pulley 45R is located ahead of the left driven pulley 45L. The second auxiliary pulley 46 is disposed on the Y-axis carriage 51. The second auxiliary pulley 46 is disposed at the right end of the body 51A. The second wire 43 is wound around the second auxiliary pulley 46. The second auxiliary pulley 46 applies a tension to the second wire 43. The second auxiliary pulley 46 and the right driven pulley 45R are aligned on an imaginary line perpendicular or substantially perpendicular the Y axis. That is, the second auxiliary pulley 46 and the right driven pulley 45R are located at the same position with respect to the Y axis. The X-axis motor 48 is connected to the second driving pulley 44. The X-axis motor 48 is connected to the second driving pulley 44 through a gear 48A. The X-axis motor 48 is an electric motor. The X-axis motor 48 is controlled by the controller 90 (see FIG. 2). When the X-axis motor 48 is driven, the second driving pulley 44 is driven to rotate. Accordingly, the X-axis carriage 41 (see FIG. 3) moves along the X-axis shaft 47 along the X axis. The X-axis motor 48 is an example of a second driving source.

As illustrated in FIG. 2, the Y-axis direction moving mechanism 52 is disposed in the housing 11. The Y-axis direction moving mechanism 52 moves the pressing body 66 of the transfer tool 60 along the Y axis. The Y-axis direction moving mechanism 52 includes a right moving mechanism 52R disposed on the right side wall portion 14, a left moving mechanism 52L disposed on a left side wall portion 13, a coupling shaft 59 (see FIG. 6) coupling a right first driving pulley 54R and a left first driving pulley 54L described later, and a Y-axis motor 58 (FIG. 6) that drives the right first driving pulley 54R and the left first driving pulley 54L. As illustrated in FIG. 6, the coupling shaft 59 extends along the X axis. The coupling shaft 59 is located below the upper wall 15. The coupling shaft 59 is located above the support base 20. The coupling shaft 59 is located behind the support base 20. The coupling shaft 59 is located behind the X-axis carriage 41. The Y-axis motor 58 is disposed on the inner wall 14A of the right side wall portion 14. The Y-axis motor 58 is located above the coupling shaft 59. The Y-axis motor 58 is connected to the coupling shaft 59 through a gear 58A. That is, the Y-axis motor 58 is connected to the right first driving pulley 54R and the left first driving pulley 54L through the gear 58A and the coupling shaft 59. The Y-axis motor 58 is an electric motor. The Y-axis motor 58 is controlled by the controller 90 (see FIG. 2). When the Y-axis motor 58 is driven, the right first driving pulley 54R and the left first driving pulley 54L are driven to rotate. The Y-axis motor 58 is an example of the first driving source.

Figure 7:
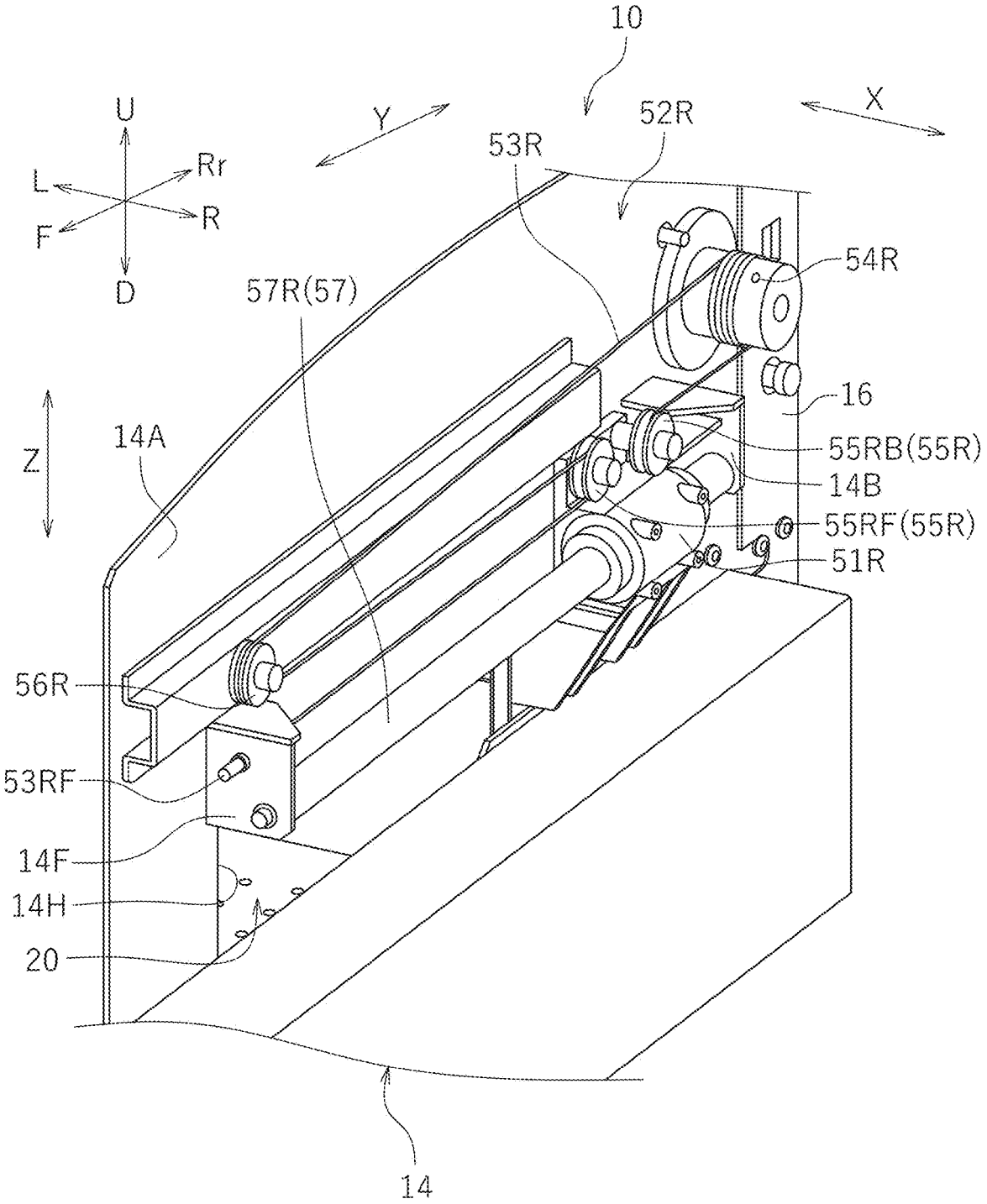
FIG. 7 is a perspective view schematically illustrating a portion of the Y-axis direction moving mechanism when an Y-axis carriage according to a preferred embodiment of the present invention is located at a rearmost position.

As illustrated in FIG. 7, the right moving mechanism 52R includes a right first wire 53R, a right first driving pulley 54R, a right first driven pulley 55R, and a right first auxiliary pulley 56R. The right first wire 53R is located at the right of the support base 20. The right first wire 53R is located above the right Y-axis shaft 57R. A front end 53RF of the right first wire 53R is fixed to the front support plate 14F. A rear end 53RB (see FIG. 8) of the right first wire 53R is fixed to the rear support plate 14B. The right first wire 53R is sequentially wound around a front driven pulley 55RF described later, the right first auxiliary pulley 56R, the right first driving pulley 54R, and a rear driven pulley 55RB, from the front end 53RF to the rear end 53RB. The right first driving pulley 54R is configured to retract and pay out the right first wire 53R. That is, the right first wire 53R can be wound around the right first driving pulley 54R multiple times. The right first driving pulley 54R is disposed in the housing 11. The right first driving pulley 54R is disposed on an upper rear portion of the inner wall 14A of the right side wall portion 14. The right first driven pulley 55R is disposed on the right sliding member 51R of the Y-axis carriage 51 (see FIG. 2). The right first wire 53R is wound around the right first driven pulley 55R. As illustrated in FIG. 8, the right first driven pulley 55R is located between the right first auxiliary pulley 56R and the right first driving pulley 54R when seen along the X axis (i.e., in side view). The right first driven pulley 55R includes the front driven pulley 55RF and the rear driven pulley 55RB located behind the front driven pulley 55RF. As illustrated in FIG. 6, the front driven pulley 55RF is located at the left of the rear driven pulley 55RB. The right first auxiliary pulley 56R is disposed in the housing 11. As illustrated in FIG. 8, the right first auxiliary pulley 56R is disposed on an upper front portion of the inner wall 14A of the right side wall portion 14. The right first wire 53R is wound around the right first auxiliary pulley 56R. The right first auxiliary pulley 56R applies a tension to the right first wire 53R. As illustrated in FIG. 6, the right first auxiliary pulley 56R and the front driven pulley 55RF are aligned on an imaginary line perpendicular or substantially perpendicular the X axis. That is, the right first auxiliary pulley 56R and the front driven pulley 55RF are located at the same position with respect to the X axis.

As illustrated in FIG. 9, the left moving mechanism 52L includes a left first wire 53L, the left first driving pulley 54L, a left first driven pulley 55L, and the left first auxiliary pulley 56L. The left first wire 53L is located at the left of the support base 20. The left first wire 53L is located above the left Y-axis shaft 57L. The front end 53LF of the left first wire 53L is fixed to the front support plate 13F. A rear end 53LB of the left first wire 53L is fixed to the rear support plate 13B. The left first wire 53L is sequentially wound around a front driven pulley 55LF described later, the left first auxiliary pulley 56L, the left first driving pulley 54L, and a rear driven pulley 55LB described later, from the front end 53LF to the rear end 53LB. The left first driving pulley 54L is configured to retract and pay out the left first wire 53L. That is, the left first wire 53L can be wound around the left first driving pulley 54L multiple times. The left first driving pulley 54L is disposed in the housing 11. The left first driving pulley 54L is disposed on an upper rear portion of the inner wall 13A of the left side wall portion 13. The left first driven pulley 55L is disposed on the left sliding member 51L of the Y-axis carriage 51 (see FIG. 2). The left first wire 53L is wound around the left first driven pulley 55L. The left first driven pulley 55L is located between the left first auxiliary pulley 56L and the left first driving pulley 54L when seen along the X axis (i.e., in side view). The left first driven pulley 55L includes the front driven pulley 55LF and the rear driven pulley 55LB located behind the front driven pulley 55LF. As illustrated in FIG. 6, the front driven pulley 55LF is located at the left of the rear driven pulley 55LB. As illustrated in FIG. 9, the left first auxiliary pulley 56L is disposed in the housing 11. The left first auxiliary pulley 56L is disposed on an upper front portion of the inner wall 13A of the left side wall portion 13. The left first wire 53L is wound around the left first auxiliary pulley 56L. The left first auxiliary pulley 56L applies a tension to the left first wire 53L. As illustrated in FIG. 6, the left first auxiliary pulley 56L and the front driven pulley 55LF are aligned on an imaginary line perpendicular or substantially perpendicular the X axis. That is, the left first auxiliary pulley 56L and the front driven pulley 55LF are located at the same position with respect to the X axis.

Figure 10:
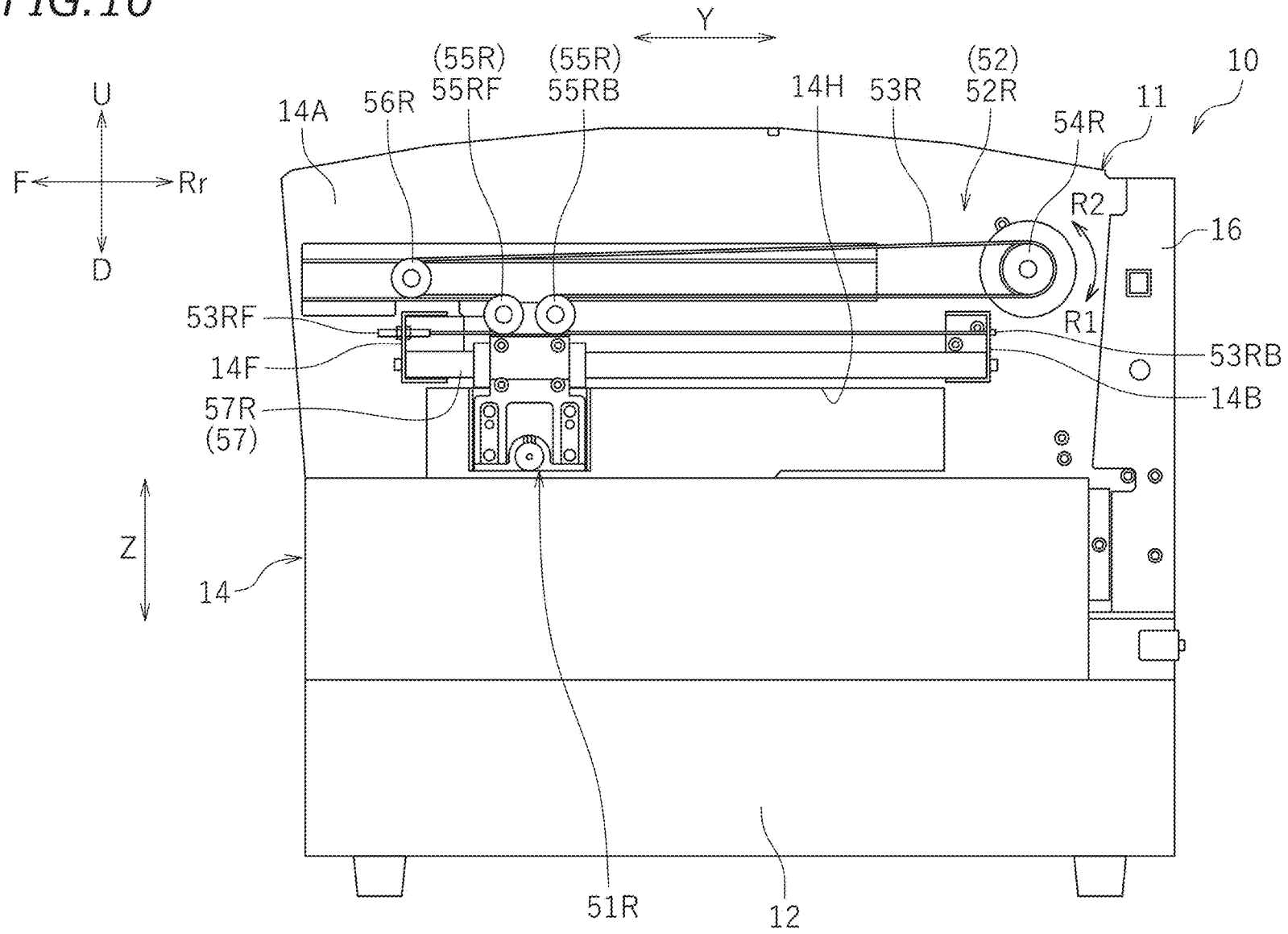
FIG. 10 is a right side view schematically illustrating a portion of a Y-axis direction moving mechanism when a Y-axis carriage according to a preferred embodiment is located at a frontmost position.

In the state illustrated in FIG. 8, when the Y-axis motor 58 is driven in one direction, the right first driving pulley 54R is driven to rotate in a direction indicated by an arrow R1 in FIG. 8. At this time, the left first driving pulley 54L is driven to rotate in a direction indicated by an arrow R1 in FIG. 9. Accordingly, the right sliding member 51R and the left sliding member 51L of the Y-axis carriage 51 move forward along the right Y-axis shaft 57R and the left Y-axis shaft 57L. That is, the Y-axis carriage 51 moves forward along the Y-axis shafts 57. FIG. 10 is a side view illustrating a state where the Y-axis carriage 51 is located at a frontmost position. On the other hand, in the state illustrated in FIG. 10, when the Y-axis motor 58 is driven in a direction opposite to the one direction described above, the right first driving pulley 54R is driven to rotate in a direction indicated by an arrow R2 in FIG. 8. At this time, the left first driving pulley 54L is driven to rotate in a direction indicated by an arrow R2 in FIG. 9. Accordingly, the right sliding member 51R and the left sliding member 51L of the Y-axis carriage 51 move rearward along the right Y-axis shaft 57R and the left Y-axis shaft 57R. That is, the Y-axis carriage 51 moves rearward along the Y-axis shafts 57. FIG. 8 is a side view illustrating a state where the Y-axis carriage 51 is located at a rearmost position.

Figure 11:
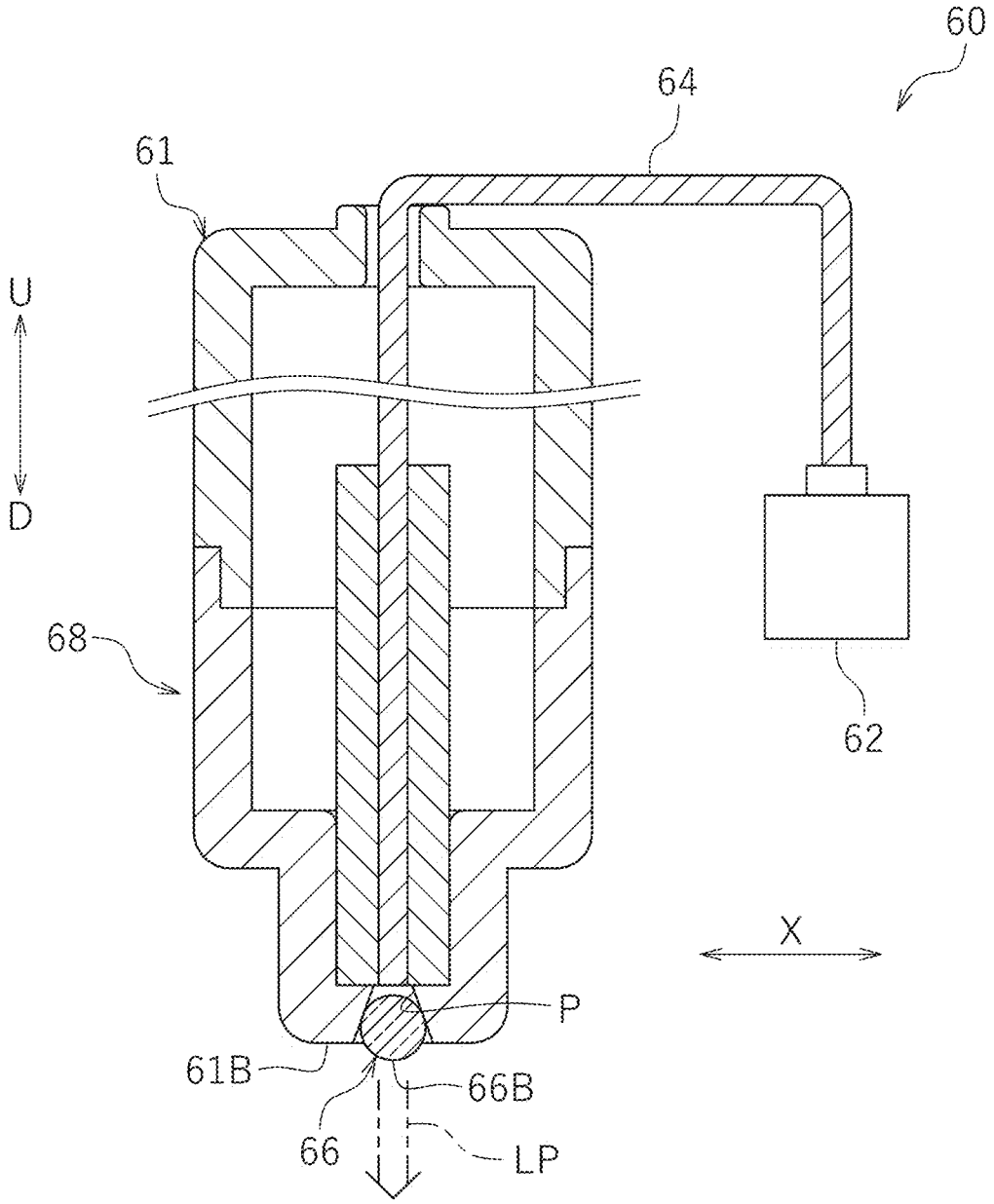
FIG. 11 is a cross-sectional view schematically illustrating a transfer tool according to a preferred embodiment of the present invention.

As illustrated in FIG. 2, the transfer tool 60 is an apparatus configured to press the thermal transfer foil 82 placed on the transfer object 80 and apply light (e.g., laser light) toward the thermal transfer foil 82. In the case of using the light absorption film 84, the light absorption film 84 is pressed by the transfer tool 60. The transfer tool 60 is an apparatus that applies light to the thermal transfer foil 82 placed on the transfer object 80 and the light absorption film 84 and supply heat to the thermal transfer foil 82. The transfer tool 60 is disposed above the support base 20. As illustrated in FIG. 11, the transfer tool 60 includes a laser oscillator 62, a case body 61, and a pressing body 66 detachably held at the lower end of the case body 61. The laser oscillator 62 is an example of a light source.

As illustrated in FIG. 3, the case body 61 is held by the Z-axis carriage 31. As illustrated in FIG. 11, the case body 61 preferably has a long cylindrical shape. The case body 61 houses a portion of optical fibers 64 connected to the laser oscillator 62. The case body 61 includes a holder 68 that holds the pressing body 66. The holder 68 has a through hole P penetrating the holder 68 along the X axis. The pressing body 66 is held to overlap with the through hole P. End portions of the optical fibers 64 overlap with the through hole P. Accordingly, the holder 68 does not interfere with a light path LP of laser light.

As illustrated in FIG. 11, the pressing body 66 projects downward from the lower surface 61B (i.e., corresponding to the lower surface of the holder 68) of the case body 61. The pressing body 66 presses the transfer object 80 and the thermal transfer foil 82 placed on the transfer object 80. In the case of using the light absorption film 84, the pressing body 66 presses the light absorption film 84. The pressing body 66 is configured to apply light to the thermal transfer foil 82. In a case where the light absorption film 84 is placed on the thermal transfer foil 82, the pressing body 66 applies light to the light absorption film 84. This operation means that light is applied to the thermal transfer foil 82 in a case where the thermal transfer foil 82 is located at a destination of light through the light absorption film 84. As will be described later, laser light generated by the laser oscillator 62 is applied to the outside through the pressing body 66. The pressing body 66 may be made of, for example, glass. The pressing body 66 in this preferred embodiment is made of synthetic quartz glass. The pressing body 66 defines and functions as a lens.

The laser oscillator 62 generates laser light. Laser light generated by the laser oscillator 62 reaches the pressing body 66 through the optical fibers 64. Laser light that has reached the pressing body 66 is applied to the outside of the case body 61 through the pressing body 66. The laser oscillator in this preferred embodiment includes a laser diode (semiconductor laser) to apply laser light and an optical system, for example. The laser oscillator 62 is controlled by the controller 90. As illustrated in FIG. 3, the laser oscillator 62 is located on the X-axis carriage 41. That is, the laser oscillator 62 moves along the X axis and the Y axis in accordance with movement of the X-axis carriage 41.

The overall operation of the foil transfer apparatus 10 is controlled by the controller 90. The controller 90 is communicably connected to the pressing body moving mechanism 30 and the laser oscillator 62 of the transfer tool 60 and is configured to enable control of the pressing body moving mechanism 30 and the laser oscillator 62. The controller 90 is communicably connected to the Z-axis motor 38, the X-axis motor 48, and the Y-axis motor 58, and is configured to enable control of these motors. The controller 90 is typically a computer.

As described above, in the foil transfer apparatus 10 of this preferred embodiment, the transfer tool 60 is moved by the Y-axis direction moving mechanism 52 along the Y axis (in the front-rear direction in this preferred embodiment) and by the X-axis direction moving mechanism 42 along the X axis (in the left-right direction in this preferred embodiment). In this preferred embodiment, the Y-axis direction moving mechanism 52 moves the Y-axis carriage 51 by using the left first wire 53L and the right first wire 53R, whereas the X-axis direction moving mechanism 42 moves the X-axis carriage 41 by using the second wire 43. In this manner, the transfer tool 60 can be moved at high speed with a thrust smaller than that in the case of using feed screw rods. That is, an increase in size of a driving source (i.e., the X-axis motor 48 and the Y-axis motor 58 in this preferred embodiment) is prevented. In addition, the movable range of the transfer tool 60 can be enlarged by changing the lengths of the left first wire 53L, the right first wire 53R, and the second wire 43. In this manner, the thermal transfer foil 82 can be transferred onto the relatively large transfer object 80.

In the foil transfer apparatus 10 of this preferred embodiment, the pressing body moving mechanism 30 includes the Z-axis shaft 37 located above the support base 20, disposed on the X-axis carriage 41, and extending along the Z axis (i.e., in the top-bottom directions in this preferred embodiment), the Z-axis carriage 31 located above the support base 20, slidably disposed on the Z-axis shaft 37, holding the transfer tool 60, and movable along the Z axis, and the Z-axis direction moving mechanism 32 configured to move the Z-axis carriage 31 in the top-bottom directions. The Z-axis direction moving mechanism 32 includes the trapezoidal screw 39 extending along the Z axis and connected to the Z-axis carriage 31, and the Z-axis motor 38 connected to the trapezoidal screw 39 and configured to drive and rotate the trapezoidal screw 39. As described above, the transfer tool 60 is moved by the Z-axis direction moving mechanism 32 along the Z axis. In this preferred embodiment, the Z-axis direction moving mechanism 32 moves the Z-axis carriage 31 by using the trapezoidal screw 39. In this manner, the transfer tool 60 held by the Z-axis carriage 31 can be more accurately moved along the Z axis.

In the foil transfer apparatus 10 of this preferred embodiment, the Y-axis direction moving mechanism 52 includes the left first auxiliary pulley 56L which is disposed in the housing 11 and configured to apply a tension to the left first wire 53L and around which the left first wire 53L is wound. The left first driven pulley 55L is located between the left first auxiliary pulley 56L and the left first driving pulley 54L when seen along the X axis. Accordingly, an appropriate tension is always applied to the left first wire 53L so that accuracy in moving the Y-axis carriage 51 is improved.

In the foil transfer apparatus 10 of this preferred embodiment, the left first auxiliary pulley 56L and the left first driven pulley 55L are aligned on an imaginary line perpendicular or substantially perpendicular the X axis. Accordingly, a force along the X axis to the Y-axis carriage 51 is reduced when the left first wire 53L is retracted or paid out from the left first driving pulley 54L, and thus, the Y-axis carriage 51 can be moved with relatively small power. That is, the size of the Y-axis motor 58 can be reduced.

In the foil transfer apparatus 10 of this preferred embodiment, the X-axis direction moving mechanism 42 includes the second auxiliary pulley 46 which is disposed on the Y-axis carriage 51 and configured to apply a tension to the second wire 43 and around which the second wire 43 is wound. The second driven pulley 45 is located between the second auxiliary pulley 46 and the second driving pulley 44 when seen along the Y axis. Accordingly, an appropriate tension is always applied to the second wire 43 so that accuracy in moving the X-axis carriage 41 is improved.

In the foil transfer apparatus 10 of this preferred embodiment, the second auxiliary pulley 46 and the second driven pulley 45 are aligned on an imaginary line perpendicular or substantially perpendicular the Y axis. Accordingly, a force along the Y axis to the X-axis carriage 41 is reduced when the second wire 43 is retracted or paid out from the second driving pulley 44, and thus, the X-axis carriage 41 can be moved with relatively small power. That is, the size of the X-axis motor 48 is able to be reduced.

In the foil transfer apparatus 10 of this preferred embodiment, the X-axis shaft 47 includes the upper X-axis shaft 47A extending along the X axis and the lower X-axis shaft 47B extending along the X axis and located below the upper X-axis shaft 47A. The X-axis direction moving mechanism 42 is located below the upper X-axis shaft 47A and above the lower X-axis shaft 47B. In this manner, the X-axis carriage 41 can be smoothly moved along the upper X-axis shaft 47A and the lower X-axis shaft 47B, and an increase in size of the X-axis direction moving mechanism 42 along the Z axis (i.e., in the top-bottom directions in this preferred embodiment) by effectively using space between the upper X-axis shaft 47A and the lower X-axis shaft 47B.

In the foil transfer apparatus 10 of this preferred embodiment, the Y-axis motor 58 is connected to the right first driving pulley 54R and the left first driving pulley 54L through the coupling shaft 59, and is configured to drive and rotate the right first driving pulley 54R and the left first driving pulley 54L. The Y-axis carriage 51 moves along the right Y-axis shaft 57R and the left Y-axis shaft 57L along the Y axis, and thus, is able to move smoothly. In addition, since one Y-axis motor 58 is capable of driving and rotating the right first driving pulley 54R and the left first driving pulley 54L, control and configuration can be simplified.

In the foil transfer apparatus 10 of this preferred embodiment, the laser oscillator 62 that applies light to the thermal transfer foil 82 through the pressing body 66 is mounted on the X-axis carriage 41. Accordingly, a light path from the laser oscillator 62 to the pressing body 66 is able to be simplified.

The foregoing description is directed to the preferred embodiments of the present invention. The preferred embodiments described above, however, are merely examples, and the present invention can be performed in various modes.

In the preferred embodiments described above, the left first wire 53L paid out from the left first driving pulley 54L, for example, is connected to the front driven pulley 55LF by way of the left first auxiliary pulley 56L, but the present invention is not limited to this example. For example, the left first wire 53L paid out from the left first driving pulley 54L may be directly connected to the front driven pulley 55LF. The same holds for the right first wire 53R paid out from the right first driving pulley 54R and the second wire 43 paid out from the second driving pulley 44. That is, the right first auxiliary pulley 56R and/or the second auxiliary pulley 46 may be omitted.

In the preferred embodiments described above, the Y-axis direction moving mechanism 52 includes the right moving mechanism 52R and the left moving mechanism 52L, but may include only one of these mechanisms.

The terms and expressions used herein are for description only and are not to be interpreted in a limited sense. These terms and expressions should be recognized as not excluding any equivalents to the elements shown and described herein and as allowing any modification encompassed in the scope of the claims. Preferred embodiments of the present invention may be embodied in many various forms. This disclosure should be regarded as providing preferred embodiments of the principles of the present invention. These preferred embodiments are provided with the understanding that they are not intended to limit the present invention to the preferred embodiments described in the specification and/or shown in the drawings. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or referred to during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A foil transfer apparatus comprising:

a housing;

a support base located in the housing and including a mount surface on which a transfer object is allowed to be mounted;

a transfer tool to press the transfer object and thermal transfer foil placed on the transfer object and to apply light to the thermal transfer foil; and a moving mechanism to move the transfer tool relative to the support base; wherein the moving mechanism includes:

a first guide shaft located above the support base, located in the housing, and extending in a first direction, the first direction being parallel or substantially parallel to the mount surface;

a first carriage located above the support base, slidably disposed on the first guide shaft, and movable in the first direction;

a first carriage moving mechanism to move the first carriage in the first direction;

a second guide shaft located above the support base, disposed on the first carriage, and extending in a second direction perpendicular or substantially perpendicular the first direction;

a second carriage located above the support base, slidably disposed on the second guide shaft, holding the transfer tool, and movable in the second direction; and a second carriage moving mechanism to move the second carriage in the second direction;

the first carriage moving mechanism includes:

a first wire;

a first driving pulley in the housing to retract and pay out the first wire;

a first driven pulley on the first carriage, the first wire being wound around the first driven pulley; and a first driving source connected to the first driving pulley to drive and rotate the first driving pulley; and the second carriage moving mechanism includes:

a second wire;

a second driving pulley on the first carriage to retract and pay out the second wire;

a second driven pulley on the second carriage, the second wire being wound around the second driven pulley; and a second driving source connected to the second driving pulley to drive and rotate the second driving pulley.

2. The foil transfer apparatus according to claim 1, wherein the moving mechanism includes:

a third guide shaft located above the support base and on the second carriage, and extending in a top-bottom direction;

a third carriage located above the support base, slidably provided on the third guide shaft, holding the transfer tool, and movable in the top-bottom direction; and a third carriage moving mechanism to move the third carriage in the top-bottom direction; and the third carriage moving mechanism includes:

a feed screw extending in the top-bottom direction and connected to the third carriage; and a third driving source connected to the feed screw to drive and rotate the feed screw.

3. The foil transfer apparatus according to claim 1, wherein the first carriage moving mechanism includes a first auxiliary pulley in the housing to apply a tension to the first wire, the first wire being wound around the first auxiliary pulley; and the first driven pulley is located between the first auxiliary pulley and the first driving pulley when seen in the second direction.

4. The foil transfer apparatus according to claim 3, wherein the first auxiliary pulley and the first driven pulley are aligned on an imaginary line perpendicular or substantially perpendicular the second direction.

5. The foil transfer apparatus according to claim 1, wherein the second carriage moving mechanism includes a second auxiliary pulley on the first carriage to apply a tension to the second wire, the second wire being wound around the second auxiliary pulley; and the second driven pulley is located between the second auxiliary pulley and the second driving pulley when seen in the first direction.

6. The foil transfer apparatus according to claim 5, wherein the second auxiliary pulley and the second driven pulley are aligned on an imaginary line perpendicular or substantially perpendicular the first direction.

7. The foil transfer apparatus according to claim 1, wherein the second guide shaft includes an upper second guide shaft extending in the second direction and a lower second guide shaft extending in the second direction and located below the upper second guide shaft; and the second carriage moving mechanism is located below the upper second guide shaft and above the lower second guide shaft.

8. The foil transfer apparatus according to claim 1, wherein supposing one side in the second direction is right and another side in the second direction is left:

the first wire includes a right first wire located at right of the support base and a left first wire located at left of the support base;

the first driving pulley includes a right first driving pulley to retract and pay out the right first wire and provided in the housing and a left first driving pulley to retract and pay out the left first wire and disposed in the housing;

the first driven pulley includes a right first driven pulley on the first carriage and around which the right first wire is wound and a left first driven pulley on the first carriage and around which the left first wire is wound;

the first carriage moving mechanism includes a coupling shaft extending in the second direction and coupling the right first driving pulley and the left first driving pulley; and the first driving source is connected to the right first driving pulley and the left first driving pulley through the coupling shaft to drive and rotate the right first driving pulley and the left first driving pulley.

9. The foil transfer apparatus according to claim 1, wherein the transfer tool includes:

a case body;

a pressing body in the case body to press the transfer object and the thermal transfer foil placed on the transfer object and to apply light to the thermal transfer foil; and a light source to apply light to the thermal transfer foil through the pressing body; wherein the light source is mounted on the second carriage.

* * * * *